US005973265A

United States Patent [19]

O'Brien et al.

[11] Patent Number: 5,973,265

[45] Date of Patent: Oct. 26, 1999

[54] WIRE HARNESS WITH SPLICE LOCATORS

[75] Inventors: Timothy F. O'Brien, White Lake; Joseph J. Davis, Jr., Ortonville; Jeffrey A. Branch, Eastpointe; Michael Vincent Maher, Dearborn, all of Mich.

[73] Assignee: Lear Automotive Dearborn, Inc., Southfield, Mich.

[21] Appl. No.: 08/920,589

[22] Filed: Aug. 29, 1997

[51] Int. Cl.[6] ..... H01B 3/00

[52] U.S. Cl. ..... 174/72 A; 174/72 R; 174/73.1; 174/117 F

[58] Field of Search ..... 174/72 A, 73.1, 174/74 R, 75 R, 117 F, 112, 36, 72 R

[56] References Cited

U.S. PATENT DOCUMENTS

| | | | |
|---|---|---|---|
| D. 014,451 | 11/1883 | Pond | 174/112 |
| 2,639,312 | 5/1953 | Kerwin | 174/138 |
| 2,933,550 | 4/1960 | Cole et al. | 174/76 |
| 2,991,328 | 7/1961 | Lay | 174/72 A |
| 3,946,768 | 3/1976 | Fiorentino . | |
| 3,985,951 | 10/1976 | Harris . | |
| 4,107,451 | 8/1978 | Smith, Jr. et al. | 174/84 R |
| 4,158,746 | 6/1979 | Taylor et al. | 174/112 |
| 4,270,961 | 6/1981 | Faranetta et al. . | |
| 4,444,705 | 4/1984 | Kumasaka et al. . | |
| 4,653,155 | 3/1987 | Hara . | |
| 4,815,984 | 3/1989 | Sugiyama et al. | 439/211 |
| 4,923,537 | 5/1990 | Matsushima . | |
| 4,967,040 | 10/1990 | Viaud et al. | 174/36 |
| 5,030,116 | 7/1991 | Sakai et al. . | |
| 5,082,253 | 1/1992 | Suzuki et al. . | |
| 5,168,124 | 12/1992 | Takase et al. | 174/23 R |
| 5,201,019 | 4/1993 | Gallusser et al. | 385/99 |
| 5,230,146 | 7/1993 | Tsuji et al. . | |
| 5,338,014 | 8/1994 | Kitamura . | |
| 5,490,664 | 2/1996 | Justus et al. . | |
| 5,500,179 | 3/1996 | Onishi et al. . | |
| 5,535,511 | 7/1996 | Karasik . | |
| 5,536,904 | 7/1996 | Kojima et al. | 174/23 R |
| 5,583,319 | 12/1996 | Lieurance | 174/84 R |
| 5,598,627 | 2/1997 | Saka et al. . | |
| 5,703,330 | 12/1997 | Kujawski | 174/72 A |

FOREIGN PATENT DOCUMENTS

| | | |
|---|---|---|
| 1235195 | of 0000 | Canada . |
| 0114244 | of 1984 | European Pat. Off. . |
| 0235924 | 1/1987 | European Pat. Off. . |
| 0382407 | of 1990 | European Pat. Off. . |
| 0533563 | of 1993 | European Pat. Off. . |

*Primary Examiner*—Dean A. Reichard
*Assistant Examiner*—Dhiru R Patel
*Attorney, Agent, or Firm*—MacMillan, Sobanski & Todd, LLC

[57] ABSTRACT

A wire harness includes a polymer sheath integrally formed splice locators and a molded slit for a repair wire formed integrally with the sheath. The wire harness includes a plurality of wires having a continuous sheath molded around the wires. The splice locator is generally axially aligned with the splice, thereby providing a visual indicator of the location of the splice. The splice locator is preferably molded in a visibly different cross section, diameter, and color from the sheath. The wire harness further includes a molded slit extending axially along the wire harness for receiving a repair wire.

15 Claims, 1 Drawing Sheet

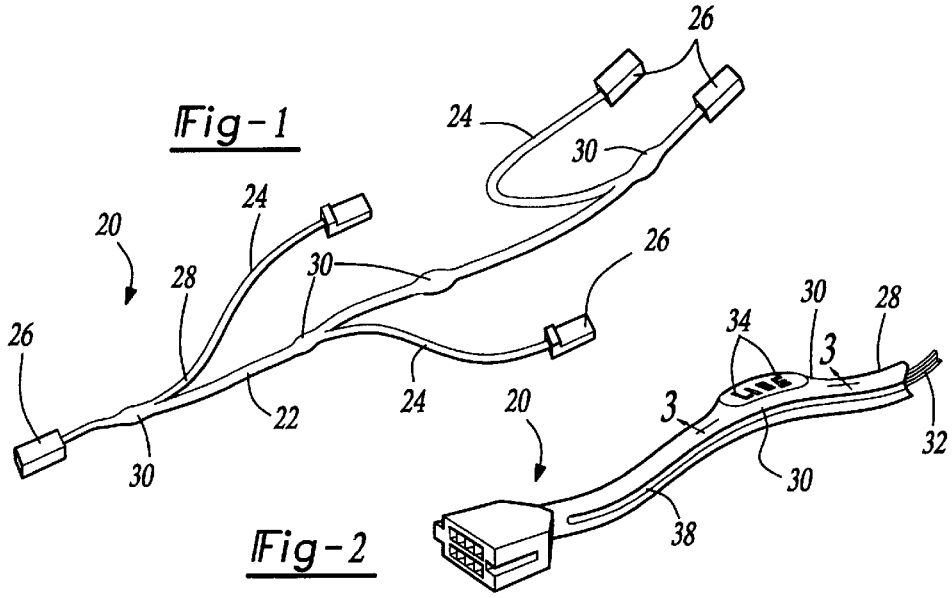
Fig-1
Fig-2
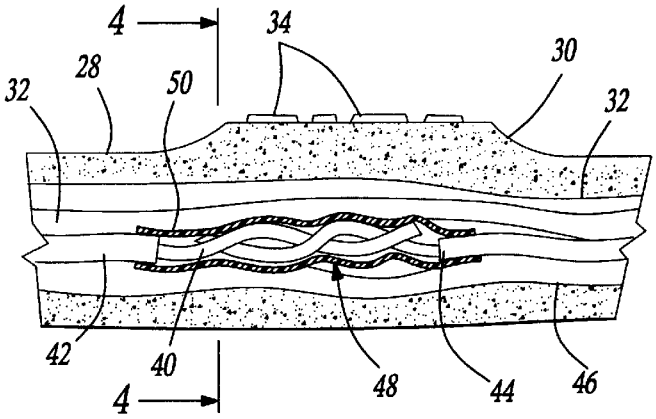
Fig-3
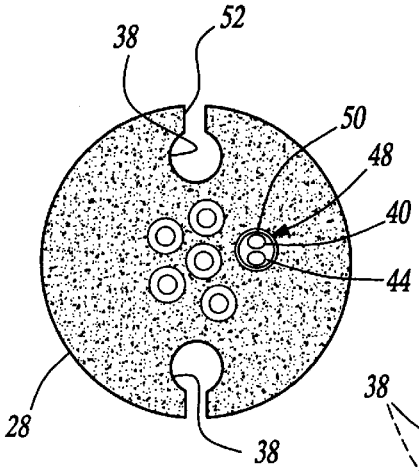
Fig-4
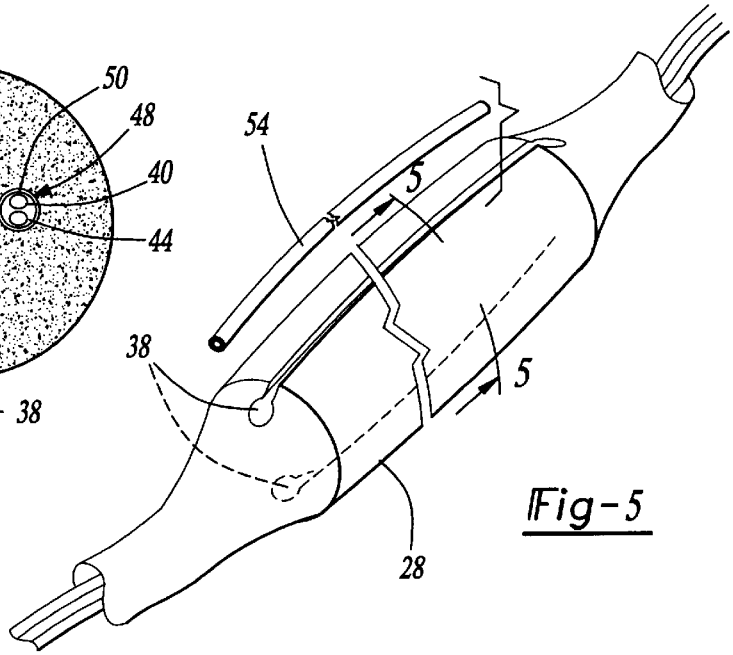
Fig-5

WIRE HARNESS WITH SPLICE LOCATORS

BACKGROUND OF THE INVENTION

The present invention relates to wire harness and more particularly to a wire harness having splice locators formed integrally with the sheath.

Current vehicles include numerous wire harnesses interconnecting an increasing number of electrical components to user-activated and computer-controlled switches and sensors. Each wire harness comprises a plurality of wires which are bundled to form a main trunk and a plurality of branches extending from the trunk. Typically, each of the branches includes an electrical connector at an outer end.

During assembly of wire harnesses, the wire bundles are held together in an assembly jig, which includes a plurality of wire supports supporting the wires along each of the main trunk and each of the branches. Each wire is placed into the assembly jig onto the appropriate wire supports, i.e. from a first branch at one end of the wire harness, through the main trunk and through a second branch, typically at an opposite end of the wire harness. Electrical connectors are then connected to the outer ends of the wires at the branches. The wires are then wrapped with tape along the entire length of the main trunk and each of the branches. Plastic tubes or sleeves are often secured around the bundled wires in selected locations to protect against mechanical wear caused by vibration. Foam sheets are often wrapped and taped about the bundles in selected areas to provide damping and reduce noise. Fasteners, such as Christmas tree connectors, are secured to the bundled wires, with the wrapped tape. Rubber gaskets or grommets are secured to selected portions of the bundled wires in order to provide water seals at selected locations. Branch identifiers, such as tape labels are often wrapped about the branches near the connectors in order to identify the branch so it is properly mounted and connected.

United Technologies Automotive has developed a new wire harness in which the wires are encased in a molded foam sheath. This is described in more detail in co-pending application U.S. Ser. No. 08/898,663, filed on Jul. 22, 1997 entitled "FOAMED-IN WIRE HARNESSES." improvements are more fully disclosed in other co-pending applications: "WIRE HARNESS WITH INTEGRAL CONNECTOR" filed on Aug. 29, 1997 and assigned U.S. Ser. No. 08/920,768; "APPARATUS FOR CENTERING WIRE HARNESS IN MOLD" filed Aug. 29, 1997 on and assigned U.S. Ser. No. 08/920,458; "METHOD AND APPARATUS FOR SECURING WIRE HARNESS TO SURFACE" filed on Aug. 29, 1997 and assigned U.S. Ser. No. 08/920,978; "MULTISHOT MOLDS FOR MANUFACTURING WIRE HARNESS" filed on Aug. 29, 1977 and assigned U.S. Ser. No. 08/920,857; "MOLD FOR ASSEMBLING AND FORMING WIRE HARNESS" filed on Aug. 29, 1977 and assigned U.S. Ser. No. 08/919.946; "FOAM WIRE HARNESS WITH SHAPE MEMORY" filed on Aug. 29, 1977 and assigned U.S. Ser. No. 08/920,570.

Current wire harnesses often include splices at several locations in the wire harness where an electrical connection is provided between two or more wires. A portion of the insulation of each wire is removed to provide electrical contact among the wires to be spliced. A dual wall heat shrink tube covers and seals the wire splice within the wire harness. The aforementioned tape is then wrapped over the splice and the rest of the wire harness as described above. Tape or labels may be used to mark the location of the splice in order to facilitate repair. The labels may be damaged or removed during installation or operation.

Should a wire fail after installation of the wire harness, a repair wire may be spliced into one of the wires in the wire harness at points on either side of the failure point. Tape is then used to secure the repair wire to the outer surface of the wire harness. Taping the repair wire to the wire harness is often difficult, time consuming and unreliable.

SUMMARY OF THE INVENTION

The present invention provides a wire harness having integrally formed splice locators and a molded slit for a repair wire formed integrally with the sheath.

The wire harness includes a plurality of wires having a continuous sheath molded around the wires. A first wire includes a first conductor electrically connected to a second conductor at a splice. The molded sheath includes an integrally molded visible splice locator on the outer surface of the sheath. The splice locator is generally axially aligned with the splice, thereby providing a visual indicator of the location of the splice. The wire harness further includes a molded slit extending axially along the wire harness for receiving a repair wire. In the event of a wire failure, a repair wire is utilized to bypass the failure point of a failed wire. The repair wire is spliced into the failed wire on either side of the failure point. The repair wire is then pressed into the molded slit of the sheath.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a wire harness according to the present invention;

FIG. 2 is an enlarged perspective view of one branch of the wire harness of FIG. 1;

FIG. 3 is a sectional view along line 3—3 of FIG. 2;

FIG. 4 is a sectional view taken along line 4—4 of FIG. 3;

FIG. 5 is a different perspective view of a of the wire harness of FIG. 3, showing the insertion of a repair wire.

DETAILED DESCRIPTION OF A PREFERRED EMBODIMENT

FIG. 1 shows a wire harness 20 according to the present invention generally comprising a main trunk 22 branching into a plurality of branches 24. An electrical connector 26 is secured to an outer end of each branch 24. The main trunk 22 and branches 24 are encased in a molded, continuous, polymer sheath 28, preferably foam, and most preferably Elastoflex® available from BASF. Other polymers could also be used.

The wire harness 20 includes a plurality of visible splice locators 30, formed integrally with the sheath 28. The splice locators 30 preferably are an area of the sheath 28 having an increased diameter and an altered cross section which is different from the remainder of the sheath 28. Further, utilizing a multi-shot mold, the splice locator 30 can also be molded in a different color.

FIG. 2 shows an enlarged area of the wire harness 20, partially broken away. As can be seen in FIG. 2, the wire harness 20 includes a plurality of wires 32 encased by sheath 28. As will be recognized, subsets of these wires 32 branch off into the branches 24. The splice locator 30 preferably also includes molded text 34, identifying or locating the splice. Any one or any combination of the aforementioned techniques, including color, diameter, cross-section, and molded text could be utilized to locate and/or identify a splice which would otherwise be hidden below sheath 28. The sheath 28 further includes a molded slit 38 formed along the length of the wire harness 20 and preferably extending into each of the branches 24 (not shown). The molded slit 38 will be described in more detail below.

A sectional view of the splice locator 30 is shown in FIG. 3. The splice locator 30 preferably has a diameter larger than that of the remainder of the sheath 28. Further, the splice locator 30 has a visibly different cross-section than the remainder of the sheath 28 and is preferably molded in a different color. Further, the splice locator 30 includes the molded text 34 which can locate or even identify the splice. As is well known, a splice is a connection point between two or more wires 32. One wire comprises a first conductor 40 surrounded by an insulator 42. A second wire 32 comprises a second conductor 44 also surrounded by an insulator 46. A portion of the insulator 42, 46 is removed from each wire 32 and the conductors 40, 44 are twisted, crimped or otherwise electrically connected to form the splice 48. Although the splice 48 is shown as connecting only two wires, it should be apparent that more than two wires could also be connected at the splice 48.

Preferably the splice 48 is then encased by a heat shrink tube 50, which completely covers the exposed conductors 40, 44. The heat shrink tube 50 and the wire harness 20 of the present invention can be a single wall heat shrink tube 50, rather than a dual wall heat shrink tube, because the splice 48 in heat shrink tube 50 will be subsequently encased by the molded sheath 28. As can be seen in FIG. 4, the splice 48, including the heat shrink tube 50, are preferably slightly spaced from the remainder of the wires 32 when molding the sheath 28. This ensures that the molded sheath 28 encases the heat shrink tube 50 including the ends to prevent moisture from reaching the exposed conductors 40, 44 in the splice 48. The molded slit 38 includes an narrowed opening 52.

After installation into a vehicle or other environment, service upon the wire harness 20 will be facilitated by the splice locators 30. The repair technician will be able to quickly locate and identify the splices 48 by noting the differing diameters, cross-sections, colors and the molded text of the splice locators 30. Since the splice locators 30 are formed integrally with the sheath 28, they will not become worn, destroyed or lost. At the splice 48, the first conductor 40 comes into electrical contact with the second conductor 44. The splice 48 is surrounded by the heat shrink tube 50 and encased and sealed by the molded sheath 28.

Referring to FIG. 5, a repair wire 54 can be utilized to bridge a failure point in a wire 32, should a wire 32 in the wire harness 20 ever fail. A portion of the sheath 28 is removed at points on either side of the failure point. The repair wire 54 is then spliced into the failed wire on either side of the failure point, thereby bridging the failure point. The repair wire 54 is pressed into the molded slit 38, which would retain and protect the repair wire 54.

The repair wire 54 is inserted into the molded slit 38 and retained by friction and the narrowed opening 52. Preferably, the repair wire 54 has an outer diameter which is greater than the opening 52 in the molded slit 38. Thus, the repair wire 54 is retained and protected by the molded slit 38.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A wire harness comprising:

a plurality of wires;

a continuous sheath molded around said plurality of wires;

said plurality of wires including a first wire comprising a first conductor connected to a second conductor at a splice;

said sheath including a visible integrally-molded splice locator on an outer surface of said sheath generally axially aligned with said splice.

2. The wire harness of claim 1 wherein said sheath includes a molded slit extending axially along said wire harness, said molded slit adapted to removably secure a wire within said slit axially along said wire harness.

3. The wire harness of claim 1 further including a tube surrounding said splice, said sheath enclosing said tube.

4. The wire harness of claim 1 wherein said sheath is molded around and among said plurality of wires.

5. The wire harness of claim 1 wherein said first conductor, said second conductor and a third conductor are electrically connected at said splice.

6. The wire harness of claim 1 wherein said sheath is generally of a first diameter, said splice locator having a second diameter visibly different from said first diameter.

7. The wire harness of claim 1 wherein said sheath is generally of a first cross-section, said splice locator having a second cross-section which is visibly different from said first cross-section.

8. The wire harness of claim 1 wherein said sheath is generally of a first color, said splice locator having a second color which is visibly different from said first color.

9. A wire harness comprising:

a main trunk having a plurality of wires;

a first branch branching from said main trunk and including a subset of said plurality of wires;

a sheath molded around and among said plurality of wires continuously over said main trunk and said first branch;

one of said plurality of wires including a first conductor in electrical contact with a second conductor at a splice;

a visual splice locator integrally molded with said sheath and generally axially aligned with said splice;

a heat shrink tube surrounding said splice, said sheath enclosing said tube;

said sheath including a molded slit extending axially along said wire harness, said molded slit adapted to removably secure a wire within said slit axially along said wire harness.

10. The wire harness of claim 9 wherein said sheath is generally of a first diameter, said splice locator having a second diameter visibly different from said first diameter.

11. The wire harness of claim 9 wherein said sheath is generally of a first cross-section, said splice locator having a second cross-section which is visibly different from said first cross-section.

12. The wire harness of claim 9 wherein said sheath is generally of a first color, said splice locator having a second color which is visibly different from said first color.

13. A wire harness comprising:

a plurality of wires;

a continuous sheath molded around said plurality of wires;

said sheath including a molded slit extending axially along said wire harness, said molded slit adapted to removably secure a wire within said slit axially along said wire harness; and a repair wire disposed within said slit and electrically connected to at least one of said plurality of wires.

14. The wire harness of claim 13 wherein said sheath is molded around and among said plurality of wires.

15. The wire harness of claim 13 wherein said repair has two opposite ends each connected to said at least one wire of said plurality of wires.

* * * * *